US008145102B2

(12) United States Patent
Tateyama et al.

(10) Patent No.: US 8,145,102 B2
(45) Date of Patent: Mar. 27, 2012

(54) DEVELOPING DEVICE, PROCESS CARTRIDGE, IMAGE FORMING APPARATUS AND DEVELOPER DISCHARGE DEVICE HAVING A DISCHARGE PORT

(75) Inventors: Susumu Tateyama, Tokyo (JP); Yoshitaka Fujinuma, Tokyo (JP); Tatsuya Kubo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 301 days.

(21) Appl. No.: 12/204,337

(22) Filed: Sep. 4, 2008

(65) Prior Publication Data

US 2009/0067878 A1 Mar. 12, 2009

(30) Foreign Application Priority Data

Sep. 7, 2007 (JP) ..... 2007-232456

(51) Int. Cl.
*G03G 15/08* (2006.01)

(52) U.S. Cl. ..... 399/257

(58) Field of Classification Search ..... 399/252–264, 399/111

See application file for complete search history.

(56) References Cited

U.S. PATENT DOCUMENTS

2006/0210318 A1* 9/2006 Murata et al. ..... 399/257
2007/0025773 A1* 2/2007 Tateyama et al. ..... 399/254
2007/0274742 A1 11/2007 Nakayama et al.
2007/0280744 A1 12/2007 Kubo et al.
2008/0008502 A1* 1/2008 Hatakeyama et al. ..... 399/254
2008/0199205 A1 8/2008 Kubo et al.

FOREIGN PATENT DOCUMENTS

JP 11219013 A * 8/1999
JP 2003-263012 9/2003
JP 2006323238 A * 11/2006

OTHER PUBLICATIONS

U.S. Appl. No. 12/196,604, filed Aug. 22, 2008, Kubo, et al.
U.S. Appl. No. 12/203,441, filed Sep. 3, 2008, Nodera, et al.

* cited by examiner

*Primary Examiner* — David Gray
*Assistant Examiner* — Billy J Lactaoen
(74) *Attorney, Agent, or Firm* — Oblon, Spivak, McClelland, Maier & Neustadt, L.L.P.

(57) ABSTRACT

A developing device, process cartridge and image forming apparatus of a premix developing system, with which developer splashed by the transport member is not discharged from the device, fluctuations of the amount of developer discharged to the outside are not produced, and the output image quality is stable. This developing device is provided with a pocket part, which is installed in a depressed manner facing the outside in relation to the transport route formed by the transport member, and into and out of which part of the developer transported in the transport route flows. This pocket part is provided with a discharge port for discharging developer to outside the device when the surface of the developer flowing into the pocket part exceeds a specified height.

21 Claims, 11 Drawing Sheets

DEVELOPING DEVICE, PROCESS CARTRIDGE, IMAGE FORMING APPARATUS AND DEVELOPER DISCHARGE DEVICE HAVING A DISCHARGE PORT

BACKGROUND OF THE INVENTION

1. Field of the Invention

The present invention relates to an image forming apparatus such as a copier, printer, facsimile device or a combination machine thereof that uses an electrophotographic system, and to a developing device and process cartridge installed therein, and more particularly relates to a developing device, process cartridge and image forming apparatus of a premix developing system that suitably supplies new carrier into the developing device.

2. Description of the Related Art

Disclosed in the past (for example, Japanese Patent Application Laid-open No. 2001-183893 (Prior Art 1) and Japanese Patent Application Laid-open No. 2000-112238 (Prior Art 2)) was technology (called a premix developing system) to suitably supplement new carrier into a developing device of an image forming apparatus such as a copier or a printer housing two-component developer comprising toner and carrier (this shall include developers to which additives are added).

In developing devices that use two-component developer, toner is suitably supplemented into the developing device from a toner supplement port provided on one part of the developing device corresponding to the consumption of toner in the developing device. The supplemental toner is agitated and mixed with the developer in the imaging apparatus by a transport member (agitating member) such as a transport screw. Part of the agitated and mixed developer is supplied to a developing roller. The developer supported on the developing roller is restricted to a suitable amount by a doctor blade, and then, in a position opposite a photosensitive drum, the toner in that two-component developer adheres to a latent image on the photosensitive drum.

In this way, carrier degrades over time because the carrier in the two-component developer housed in the developing device remains in the developing device without being consumed in the normal developing process. In more detail, this generates the "film scraping phenomenon", in which the coating layer of the carrier is abraded or peeled off due to the carrier being agitated and mixed over a long time in the developing device causing a reduction in the charge capacity of the carrier, and the "spent phenomenon", in which the toner components and additives adhere to the surface of the carrier causing a reduction in the charge capacity.

The premix developing system is for the purpose of preventing the reduction of the output image quality by this kind of carrier deterioration over time. Specifically, by suitably supplementing new carrier (or new two-component developer) into the developing device and suitably discharging some of the two-component developer housed in the developing device to outside of the developing device, the amount of deteriorated carrier in the developing device is reduced and the volume and charge capacity of the carrier housed in the developing device is maintained.

Image forming apparatuses that use this kind of premix developing system have more stable output image quality over time than do apparatuses that require replacement of the developing device and carrier with new products every time the carrier deteriorates over time.

Meanwhile, disclosed in Prior Art 1 and Prior Art 2, and the like, is an apparatus in a premix developing system that uses an overflow system as means for discharging developer to the outside of the developing device. In more detail, a discharge port (hole) is provided in a wall of the developing device, and when the developer surface that is carried to that location exceeds a specified height, that developer (developer that has become the surplus portion after supplementing carrier) is discharged to the outside from the discharge port.

Moreover, disclosed in Prior Art 2 and the like is a technology that, for the purpose of reducing the amount of developer discharged from the discharge port (developer discharge port), eliminates (or decreases the radius of) the screw part (blade) of the transport member (agitation and transport member) facing the discharge port.

In the developing device of the premix developing system of Prior Art 1 and the like described above, developer is added to the developer to be discharged until the necessary amount of developer has been discharged from the discharge port, and the amount of developer inside the developing device can become insufficient by discharging an excessive amount of the developer. Concretely, as opposed to only the developer that exceeds the specified height of the developer surface and that should be discharged from the discharge port, developer splashed by the transport member is also discharged from the discharge port.

When the amount of developer in the developing device becomes insufficient in this way, the deterioration status of the developer becomes unstable, the amount of static electricity of the toner drops, and problems occur such as an output image with decreased image concentration.

In order to resolve this kind of problem, the screw part of the transport member facing the discharge port was removed (or made a smaller diameter) in Prior Art 2. However, as a result of assiduous research, the three inventors of the present application discovered that it is not possible to fully suppress the problem of developer splashed by the transport member being discharged from the discharge port simply by removing the screw part of the transport member facing the discharge port.

SUMMARY OF THE INVENTION

An object of the present invention is to resolve the problems described above, and to provide a developing device of a premix developing system, a process cartridge, and an image forming apparatus that do not discharge from the apparatus developer splashed by the transport member, that do not produce fluctuations in the amount of developer to be discharged to the outside, and that have stable output image quality.

In an aspect of the present invention, a developing device houses developer having carrier and toner, and develops a latent image formed on an image support unit. The developing device comprises a plurality of transport members for longitudinally transporting the developer housed in the device to form a circulation route; a supply device for supplying new carrier into the device; and a pocket part, which is installed in a depressed manner facing the outside in relation to the transport route formed by one of the plurality of transport members, and into and out of which part of the developer transported in the transport route flows. The pocket part comprises a wall part that covers the side corresponding to the downstream side of the transport route, and a discharge port for discharging developer to the outside of the device when the surface of the developer flowing into the pocket part has exceeded a specified height.

In another aspect of the present invention, a process cartridge is detachably installed to an apparatus main body of an image forming apparatus. A developing device and an image support unit are formed into a single unit, and the developing device houses developer having carrier and toner, and develops a latent image formed on an image support unit. The developing device comprises a plurality of transport members for longitudinally transporting the developer housed in the device to form a circulation route;

A supply device for supplying new carrier into the device; and a pocket part, which is installed in a depressed manner facing the outside in relation to the transport route formed by one of the plurality of transport members, and into and out of which part of the developer transported in the transport route flows. The pocket part comprises a wall part that covers the side corresponding to the downstream side of the transport route, and a discharge port for discharging developer to the outside of the device when the surface of the developer flowing into the pocket part has exceeded a specified height.

In another aspect of the present invention, an image forming apparatus comprises a developing device and an image support unit. The developing device houses developer having carrier and toner, and develops a latent image formed on an image support unit. The developing device comprises a plurality of transport members for longitudinally transporting the developer housed in the device to form a circulation route; a supply device for supplying new carrier into the device; and a pocket part, which is installed in a depressed manner facing the outside in relation to the transport route formed by one of the plurality of transport members, and into and out of which part of the developer transported in the transport route flows. The pocket part comprises a wall part that covers the side corresponding to the downstream side of the transport route, and a discharge port for discharging developer to the outside of the device when the surface of the developer flowing into the pocket part has exceeded a specified height.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Optimum forms for embodying the present invention will be explained below by referring to the diagrams. In addition, the same codes will be applied to the same or equivalent parts in the diagrams, and redundant explanations will be suitably abbreviated or omitted.

Figure 1:
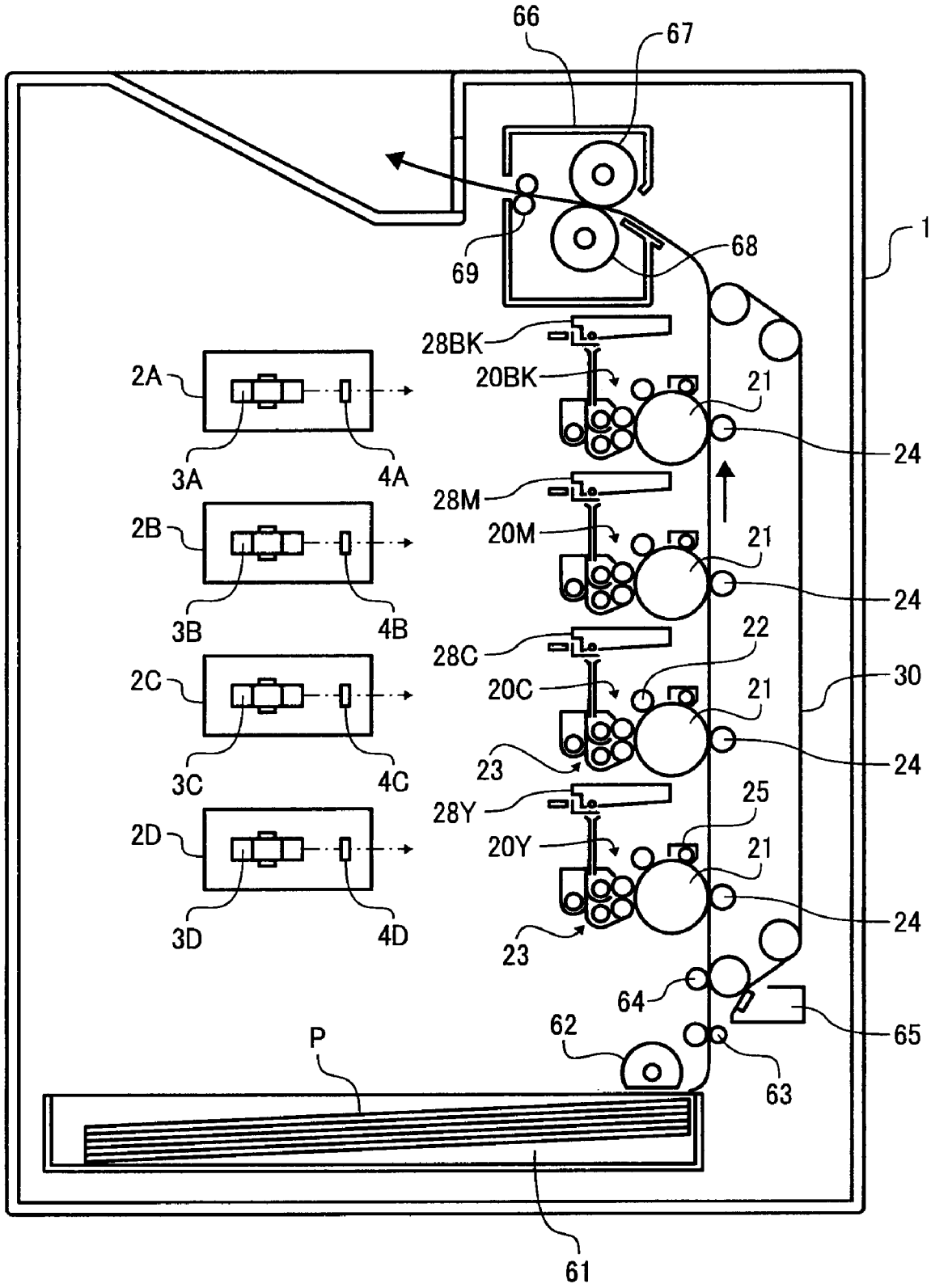
FIG. 1 is a diagram indicating the overall configuration of an image forming apparatus in one embodiment of the present invention.

First, referring to FIG. 1 of the diagrams, the configuration and operation of the image forming apparatus of the embodiment as a whole will be explained.

Writing units 2A to 2D are devices that after a charge process use image data to write electrostatic latent images onto a photosensitive drum 21 (image support unit). Writing units 2A to 2D are optical scanning devices that use polygon mirrors 3A to 3D and optical elements 4A to 4D and the like. Further, LED arrays may be used as the writing unit instead of an optical scanning device.

A paper feed unit 61 stores transfer material P such as recording paper or acetate for OHP, and the transfer material P is sent toward a transfer belt 30 during image formation.

The transfer belt 30 is an endless belt for electrostatically adsorbing the transfer material P to the surface thereof, transporting, and transferring a toner image formed on a photosensitive drum 21 onto the transfer material P; and an adsorbing roller 64 and a belt cleaner 65 are provided on the peripheral surface thereof.

A transfer roller 24 facing the photosensitive drum 21 through the transfer belt 30 has a metal core and a conductive elastic layer that covers the metal core. The conductive elastic layer of the transfer roller 24 is an elastic body that has the electric resistance value (volume resistant modulus) adjusted to middle resistance by compounding and dispersing carbon black, zinc oxide, tin oxide or the like in an elastic material such as polyurethane rubber, ethylene-propylene-diene polyethylene (EPDM) or the like.

A fixing part 66 has a heating roller 68 and a pressure roller 67, and fixes the toner image on top of the transfer material P to the transfer material P using pressure and heat.

Four process cartridges 20Y, 20C, 20M and 20BK arranged transversely along the transfer belt 30 are for the purpose of forming yellow, cyan, magenta and black toner images respectively.

Developer cartridges 28Y, 28C, 28M and 28BK are arranged on the respective process cartridges 20Y, 20C, 20M, and 20KB as supply means for supplying carrier (magnetic carrier) and toner (toner particles) of various color (yellow, cyan, magenta and black) to the developing device 23.

The process cartridges 20Y, 20C, 20M and 20KB and the developer cartridges 28Y, 28C, 28M and 28BK can be attached and detached from an apparatus main body 1 by opening the transfer belt 30 pivoting on a rotational spindle.

Further, in the present application "process cartridge" is defined as a unit which is detachably installed to the image forming apparatus main body, and in which the image support unit is integrated with at least one of a charge part that charges the image support unit, a developing part (developing device) that develops the latent image formed on the support unit, and a cleaning unit to clean the top of the image support unit.

The image forming apparatus of the present embodiment is a combination image forming apparatus that has copier and printer functions. When functioning as a copier, image data read from a scanner is converted into read data by conducting a variety of imaging processes such as A/D conversion, MTF compensation, and gradation processing. When functioning as a printer, page description language and bitmap format image data sent from a computer and the like are converted into read data by conducting image processing.

When forming images, exposure light corresponding to black, magenta, cyan and yellow image data are respectively irradiated from writing units 2A to 2D onto process cartridges 20BK, 20M, 20C and 20Y. Specifically, exposure light (laser light) generated from light sources is irradiated onto the photosensitive drums 21 through polygonal mirrors 3A to 3D and optical elements 4A to 4D. A toner image corresponding to the exposure light is thereby formed on the photosensitive drums 21 (image support unit) of the process cartridges 20BK, 20M, 20C and 20Y. Then, those toner images are transferred to the transfer material P.

Once the timing matches at the resist roller 63 position, the transfer material P sent from the paper feed unit 61 is transported to the position of the transfer belt 30. The adsorption roller 64, which is arranged in the transfer belt 30 feed-in position, causes the transfer material P that has been fed in by the application of voltage, to be adsorbed to the transfer belt 30. The transfer material P moves in conjunction with the transfer belt 30 that runs in the direction of the arrow to successively pass through the positions of the process cartridges 20Y, 20C, 20M and 20BK, and the various colored toner images are laminated and transferred thereon.

The transfer material P onto which the color toner image has been transferred is released from the transfer belt 30 and arrives at the fixing part 66. The toner image on the transfer material P is fixed onto the transfer material P by heating while being squeezed between the heating roller 68 and the pressure roller 67. Meanwhile, the surface of the transfer belt 30 after the transfer material P has been released arrives at the position of the belt cleaner 65, and the contamination such as the toner adhering to the surface thereof is cleaned off.

Next, the process cartridge and the developer cartridge of the image forming apparatus will be described in detail.

Figure 2:
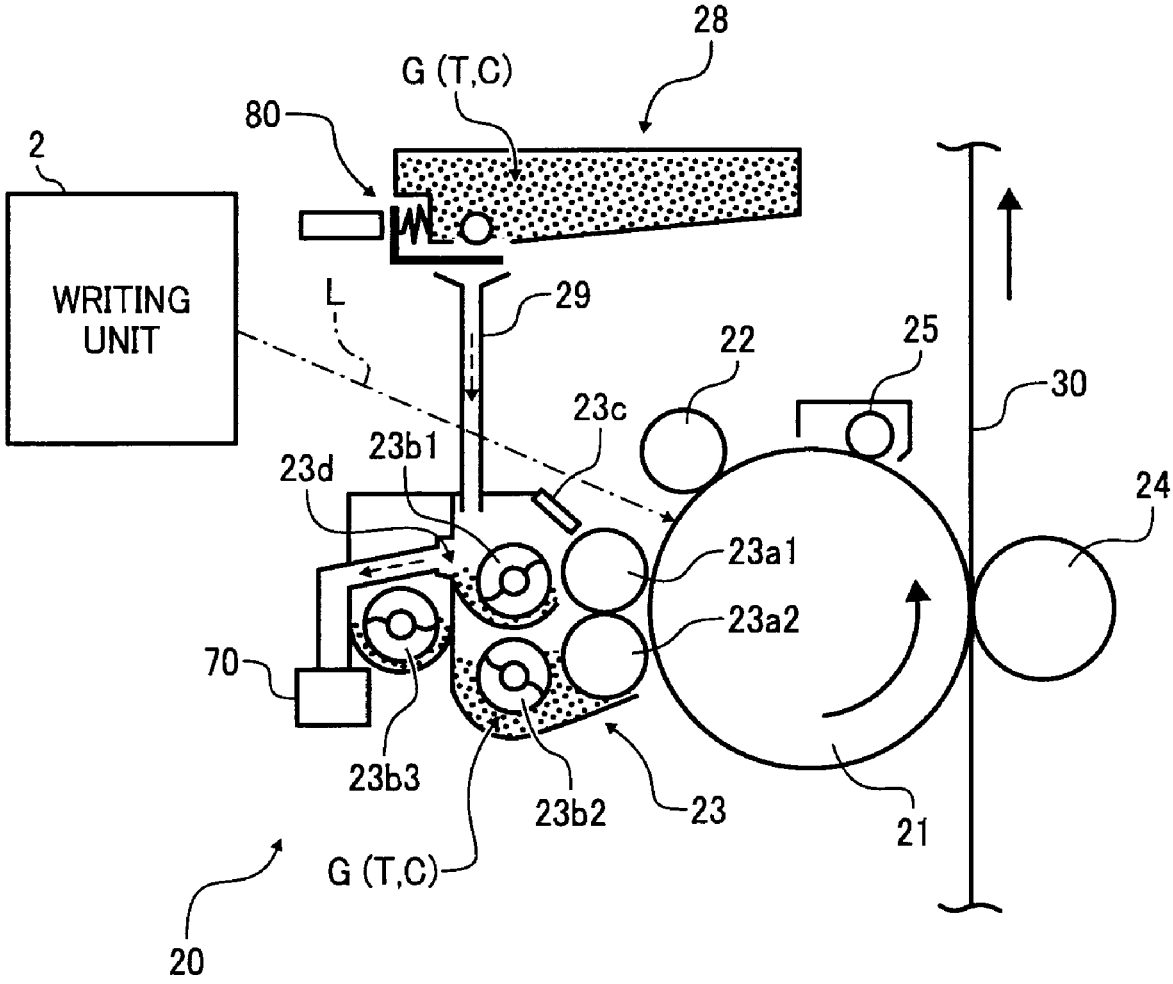
FIG. 2 is a diagram indicating a schematic configuration of a process cartridge installed in the same image forming apparatus.

Further, because the process cartridges 20Y, 20C, 20M and 20BK have nearly identical structures and the developer cartridges 28Y, 28C, 28M and 28BK have nearly identical structures, the process cartridge and the developer cartridge will be indicated without the alphabetical codes (Y, C, M and BK) in FIG. 2. In addition, the writing units will also be indicated without the alphabetical codes (A to D).

As indicated in FIG. 2, the photosensitive drum 21, which is the image support unit, a charge part 22, the developing device 23 (developing unit) and a cleaning part 25 are unified in the process cartridge 20, and the premix developing system (developing system in which carrier is suitably supplemented and discharged) has been adopted.

The photosensitive drum 21, which is the image support unit, is a negative charge organic photosensitive unit, and is rotationally driven counterclockwise by a rotational drive mechanism not indicated in the diagram.

The charge part 22 is a charge roller that has elasticity, in which a foam urethane layer with medium resistance was made by processing urethane resin, carbon black as the conductive particles, a sulfurizing agent, a foaming agent and the like, was formed into a roller shape on a metal core. A rubber material, in which conductive substances such as carbon black or metal oxides and the like, or a substance with these made into a foam are dispersed in urethane, ethylene-propylene-diene polyethylene (EPDM), acrylonitrile butadiene rubber (NBR), silicone rubber, isoprene rubber and the like in order to adjust the resistance, can be used as the substance of the medium resistance layer of the charge part 22.

The cleaning part 25 mechanically removes and recovers untransferred toner from the photosensitive drum 21 by setting up a cleaning brush (or cleaning blade) that makes sliding contact with the photosensitive drum 21.

The developing device 23 is arranged so that two developing rollers 23*a*1 and 23*a*2, which are developer support units, are arranged in close proximity to the photosensitive drum 21, and in both opposing parts, a developing region is formed where the photosensitive drum 21 and the magnetic brush make contact. Developer G (two-component developer) comprising a toner T and a carrier C are housed inside the developing device 23. Then, the developing device 23 develops the electrostatic latent image formed on the photosensitive drum 21 (forms a toner image). Further, the configuration and action of the developing device 23 will be explained in detail later.

Here, the developing device 23 of the present embodiment is the premix developing system type, and new carrier C (developer G) is suitably supplied from the developer cartridge 28 into the developing device 23, and the deteriorated developer G is discharged toward a developer storage container 70 arranged outside of the developing device 23.

Referring to FIG. 2, housed inside of the developer cartridge 28 is the developer G (toner T and carrier C) for supplying into the developing device 23. Then, the developer cartridge 28 functions as a toner cartridge to supply new toner T to the developing device 23, and functions as supply means for supplying new carrier C into the developing device 23. Concretely, developer G is suitably supplied from the developer cartridge 28, which is the supply means, into the developing device 23 by the opening and closing action of a shutter mechanism 80 based on toner concentration data (percentage of toner in the developer G) detected by a magnetic sensor 26 (refer to FIG. 4) installed on the developing device 23.

Further, in the present embodiment, the mixture percentage of toner T in relation to carrier C (toner concentration) of the developer G in the developer cartridge 28 was set comparatively high.

A supply tube 29, which is the supply means, is for the purpose of reliably leading the developer G (toner T and carrier C) supplied from the developer cartridge 28 into the developing device 23. Specifically, the developer G that is discharged from the developer cartridge 28 is supplied into the developing device 23 through the supply tube 29.

Next, the image making process that occurs on the photosensitive drum 21 will be explained.

Referring to FIG. 2, when the photosensitive drum 21 is rotationally driven, first, the surface of the photosensitive drum 21 at the position of the charge part 22 is uniformly charged. Afterwards, the surface of the charged photosensitive drum 21 arrives at the irradiation position of the exposure light L, and exposure processing is conducted by the writing unit 2. Specifically, an electrostatic latent image is formed by irradiating the photosensitive drum 21 with the exposure light L to selectively neutralize the surface thereof corresponding to the image data, thereby generating a difference (potential contrast) from the electric potential of the non-image part that is not irradiated. Further, this exposure process is one in which the load generation substance in the photosensitive layer of the photosensitive drum 21 generates a load by receiving the light, and the positive holes thereof cancel the charge load of the surface of the photosensitive drum 21.

Afterwards the surface of the photosensitive drum 21 on which the latent image is formed arrives at the position facing the developing device 23. The electrostatic latent image on the photosensitive drum 21 makes contact with the magnetic brushes on the developing rollers 23*a*1 and 23*a*2, and the image is made visible by the adherence of the negatively charged toner T from the magnetic brush.

In more detail, after the developer G, which was drawn up by magnetic force based on the magnetic pole of the upper developing roller 23*a*1, has been adjusted to a suitable amount by the doctor blade 23*c*, the developer is transported to the developing region, which is the part facing the photosensitive drum 21 (the region where the two developing rollers 23*a*1 and 23*a*2 face the photosensitive drum 21). The carrier C which is spiked up in the developing region makes sliding contact with the photosensitive drum 21. At this time, the toner T that is mixed in the carrier C is negatively charged by the friction with the carrier C. In contrast, the carrier C is positively charged. The specified developing bias is applied from a power source not indicated in the diagram to the developing rollers 23*a*1 and 23*a*2. An electric field is thereby formed between the developing rollers 23*a*1 and 23*a*2 and the photosensitive drum 21, and a toner image is formed by the negatively charged toner T selectively adhering to only the image part on the photosensitive drum 21 based on the electric field.

Afterwards, the surface of the photosensitive drum 21, on which a toner image has been formed, arrives at the position facing the transfer belt 30 and the transfer roller 24. Then, the toner image on the photosensitive drum 21 is transferred onto the transfer material P that with matching timing was transported to the opposing position. At this time, the specified voltage is applied to the transfer roller 24.

Afterwards, the transfer material P, onto which the toner image has been transferred, passes through the fixing part 66, and is discharged from the discharge roller 69 to outside of the device.

Meanwhile, the toner T remaining on the photosensitive drum 21 that has not been transferred to the transfer material P during the transfer process (untransferred toner) reaches the position facing the cleaning unit 25 with unchanged toner adhering on the photosensitive drum 21. Then, the untransferred toner on the photosensitive drum 21 is removed and collected by the cleaning part 25.

Afterwards, the surface of the photosensitive drum 21 passes through a charge removal part not indicated in the diagram, and the series of image making processes on the photosensitive drum 21 is completed.

The configuration and operation of the developing device 23 will be explained in detail below.

Figure 3:
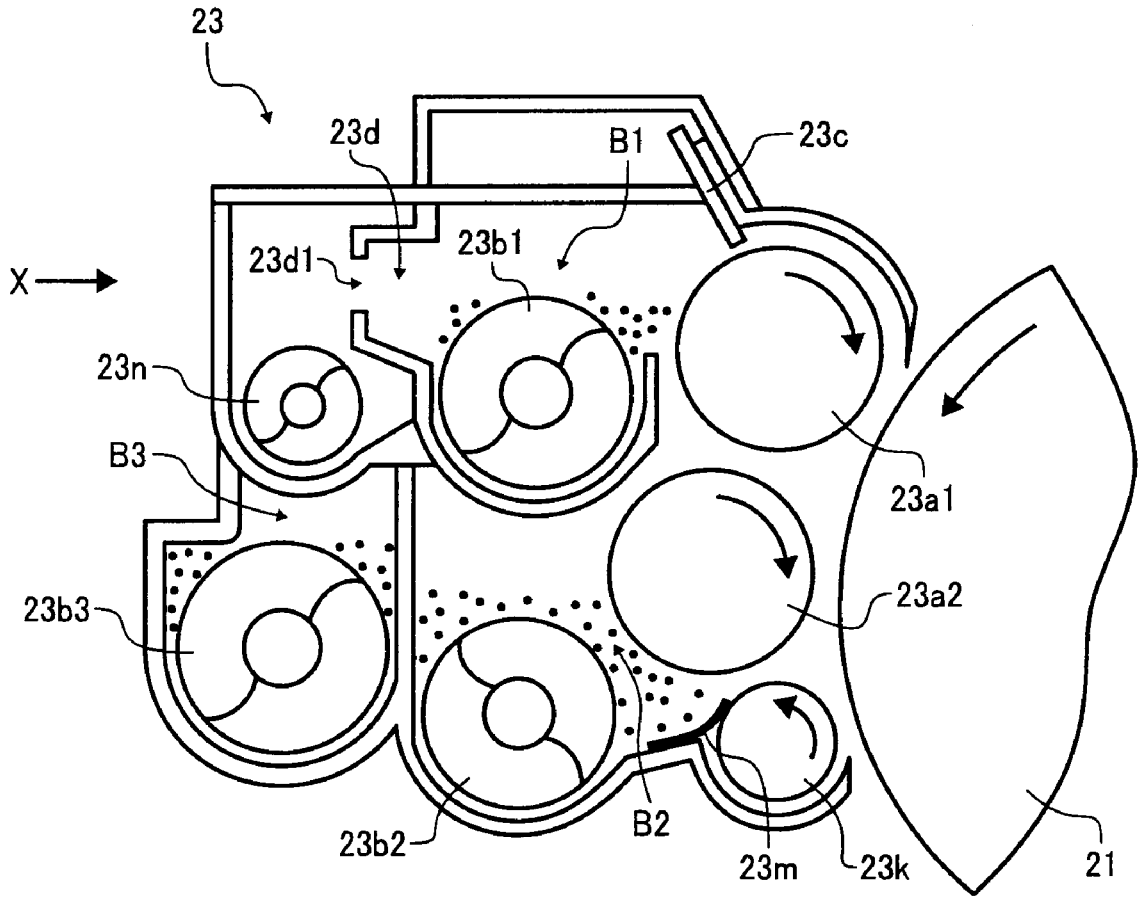
FIG. 3 is a diagram indicating the configuration of a developing device.

Referring to FIG. 3, the developing device 23 comprises developing rollers 23*a*1 and 23*a*2, which are developer support units, transport screws 23*b*1 to 23*b*3 (auger screws), which are the transport members, the doctor blade 23*c*, a carrier collection roller 23*k*, a scraper 23*m*, a discharge screw 23*n*, and the like. Moreover, three developer transport parts B1 to B3 (transport routes) that transport the developer G and form a circulation route are formed in the developing device 23.

The developing rollers 23*a*1 and 23*a*2 are configured such that a cylindrical-shaped sleeve comprising a non-magnetic material such as aluminum, brass, stainless steel, conductive resin or the like rotates clockwise based on a rotational drive mechanism not indicated in the diagram. Magnets that form a magnetic field are fixed inside the developing rollers 23*a*1 and 23*a*2 in order to produce spikes of the developer G on the peripheral surface of the sleeve. The carrier C in the developer G spikes up in a chain shape on the sleeve following the normal direction of magnetic force lines generated from the magnets. A magnetic brush is formed by the charged toner T adhering to the carrier C spiked up in this chain shape. The magnetic brush travels in the same direction (clockwise) as the sleeve based on the rotation of the sleeve.

The doctor blade 23*c* is set up on the upstream side of the developing region, and regulates the developer on the first developing roller 23*a*1 to a suitable amount.

The three transport screws 23*b*1 to 23*b*3 have a spiral screw part formed on a spindle, and agitate, mix, and circulate longitudinally (the direction perpendicular to the paper surface in FIG. 2) the developer G housed in the developing device 23.

The first transport screw 23*b*1, which is the first transport member (one transport member), is installed in the first developer transport part B1 facing the developing roller 23*a*1, transports the developer G horizontally (transports to the left indicated by the white arrow in FIG. 4), and supplies developer G onto the developing roller 23*a*1. In other words, the first developer transport part B1 faces the developing roller 23*a*1, and while transporting developer longitudinally (direction of the rotating spindle of the developing roller 23*a*1), supplies developer G to the developing roller 23*a*1.

The second transport screw 23*b*2, which is the second transport member, is installed in the second developer transport part B2. The second transport screw 23*b*2 is below the first transport screw 23*b*1, and is arranged in a position facing the developing roller 23*a*2. Then, second transport screw 23*b*2 transports horizontally (transports to the left as indicated by the white arrow in FIG. 4) the developer G that was released from the developing roller 23*a*2 (developer G that was forcibly released from above the developing roller 23*a*2 by the developer release pole after developing processing). In other words, the second developer transport part B2 is below the first developer transport part B1, is arranged in a position facing the developing roller 23*a*2, and transports developer G released from the developing roller 23*a*2 longitudinally.

The first transport screw 23*b*1 and second transport screw 23*b*2 are arranged such that the rotating spindle is nearly horizontal in the same way as the developing rollers 23*a*1 and 23*a*2, and the photosensitive drum 21.

The third transport screw 23*b*3, which is the third transport member, is installed in the third developer transport part B3. The third transport screw 23*b*3 is arranged at a diagonal in relation to horizontal such that the downstream side of the transport route formed by the second transport screw 23*b*2 and the upstream side of the transport route formed by the first transport member 23*b*1 are directly linked (refer to FIG. 4). Then, the third transport screw 23*b*3 transports the developer G transported by the second transport screw 23*b*2 to the upstream side of the transport route formed by the first transport member 23*b*1, and transports the developer G that circulates from the downstream side of the transport route formed by the first transport screw 23*b*1 through a fall route 23*f* to the upstream side of the transport route formed by the first transport member 23*b*1 (transports to the upper right diagonal indicated by the white arrow in FIG. 4). In other words, the third developer transport part B3 transports the developer G transported by the second developer transport part B2 to the upstream side of the first developer transport part B1, and transports the developer G that has arrived at the downstream side of the first developer transport part B1 to the upstream side of the first developer transport part B1.

Further, the transport route formed by the first transport screw 23*b*1 (first developer transport part B1), the transport route formed by the second transport screw 23*b*2 (second developer transport part B2), and the transport route formed by the third transport screw 23*b*3 (third developer transport part B3) are separated by walls.

Figure 4:
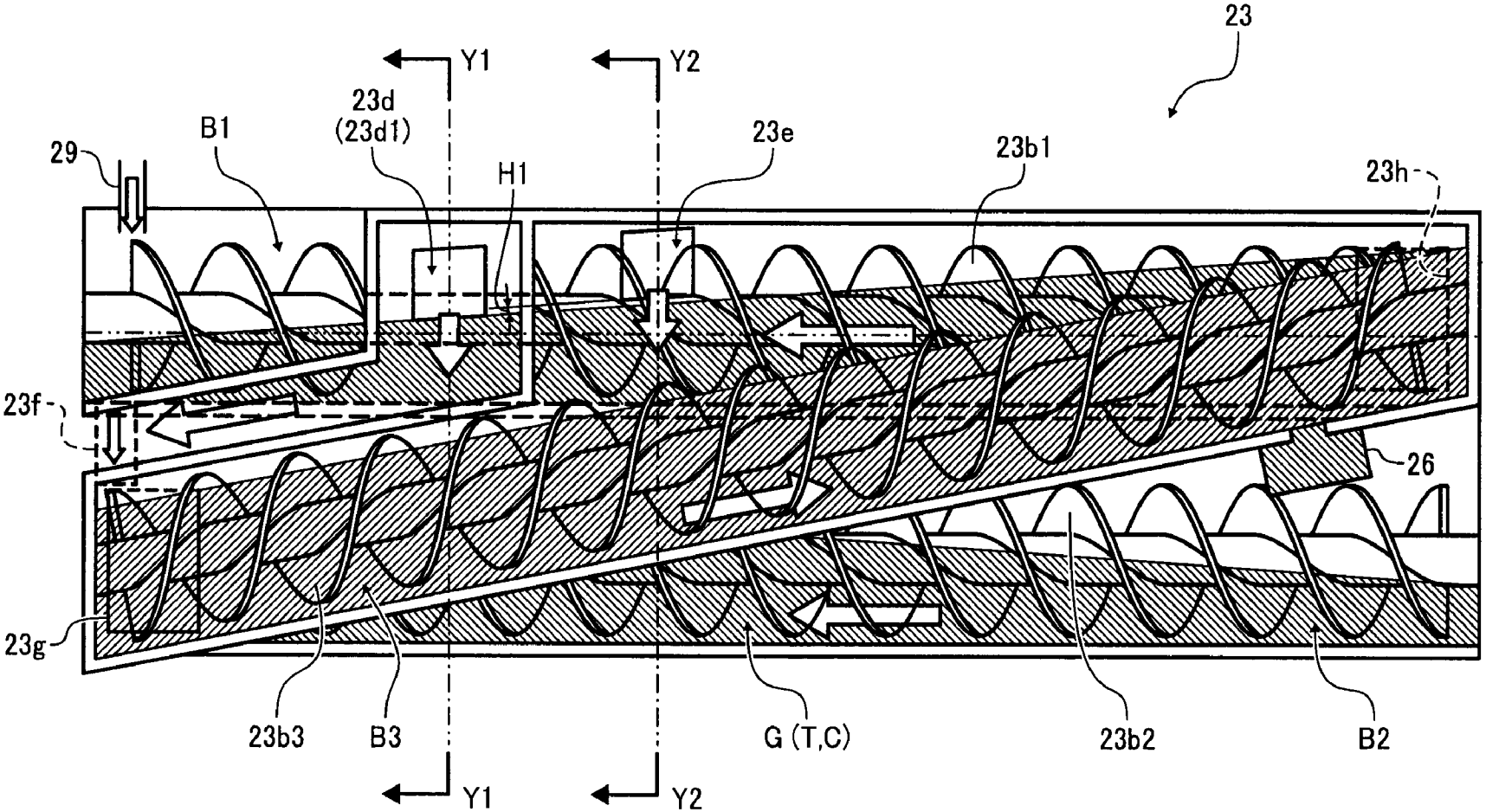
FIG. 4 is a cross-sectional diagram longitudinally viewing the circulation route of the same developing device.

Referring to FIG. 4, the downstream side of the second developer transport part B2 and the upstream side of the third developer transport part B3 are connected through a first relay part 23*g*. Moreover, the downstream side of the third developer transport part B3 and the upstream side of the first developer transport part B1 are connected through a second relay part 23*h*. In addition, the downstream side of the first developer transport part B1 and the upstream side of the third developer transport part B3 are connected through a fall route 23*f*.

According to this kind of configuration, circulation routes for circulating the developer G longitudinally in the developing device 23 are formed by the three developing transport parts B1 to B3 (transport screws 23*b*1 to 23*b*3). Here, when the developing device 23 operates, the developer housed in the device flows in the state indicated by the slanted lines in FIG. 4. Referring to FIG. 4, the reason that the surface of the developer in the downstream side of the first developer transport part B1 is lower than the surface of the upstream side is because some of the developer being transported is supplied to the developing roller 23*a*1. Specifically, the developer that is not supplied to the developing roller 23*a*1 moves to the upstream side of the third developer transport part B3 through the fall route 23*f*.

Further, a magnetic sensor 26, which is a toner concentration sensor), is installed on the third developer transport part B3. Then, based on the toner concentration data detected by the magnetic sensor 26, developer G of a specified toner concentration is supplied into the developing device 23 from the developer cartridge 28, which is the supply means. In the present embodiment, the toner concentration of the developer G inside the developing device 23 is controlled to be 4 to 7 weight %.

Figure 5:
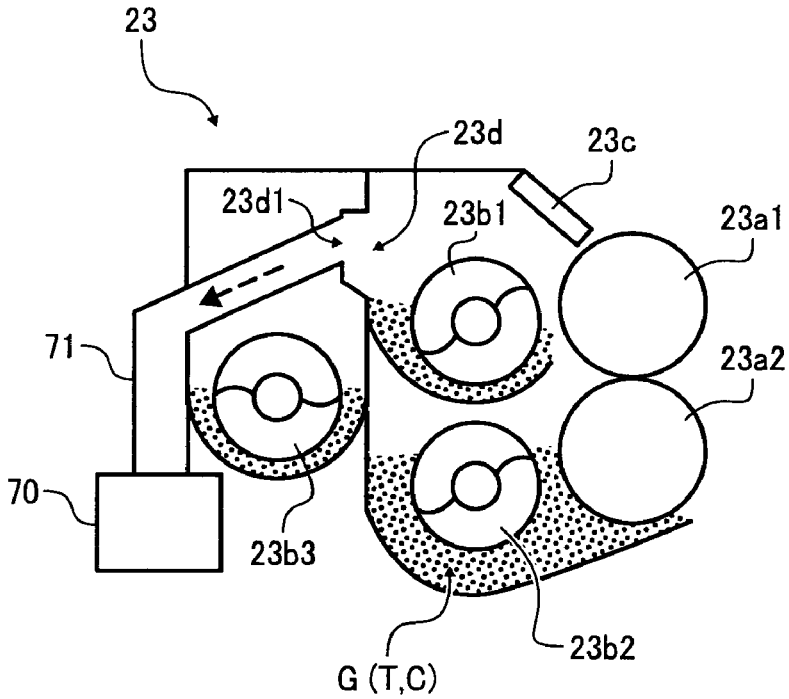
FIG. 5 is a schematic cross-sectional diagram indicating the Y1-Y1 cross-section of the circulation route of FIG. 4.

Here, referring to FIGS. 4 and 5, a pocket part 23*d* (discharge port 23*d*1) for discharging part of the developer G housed in the developing device 23 to the outside (developer storage container 70) is provided on the wall of the first developer transport part B1. In more detail, the outlet port 23*d*1 of the pocket part 23*d* is for the purpose of discharging excess developer G toward the developer storage container 70 when developer G is supplied into the developing device 23 by the supply means 28 and 29, in an amount that increases the developer in the device such that the surface (upper surface) of the developer that flows into the pocket 23*d* has exceeded a specified height. Specifically, the surplus developer G exceeds the height of the lower part of the discharge port 23*d*1, is discharged from the discharge port 23*d*1, and is transported toward the developer storage container 70 by being relayed through the discharge route 71. In this way, deterioration of the image quality over time can be restrained because carrier that has deteriorated and has become contaminated by the matrix resin of the toner T and other additives is automatically discharged outside of the developing unit.

Figure 8:
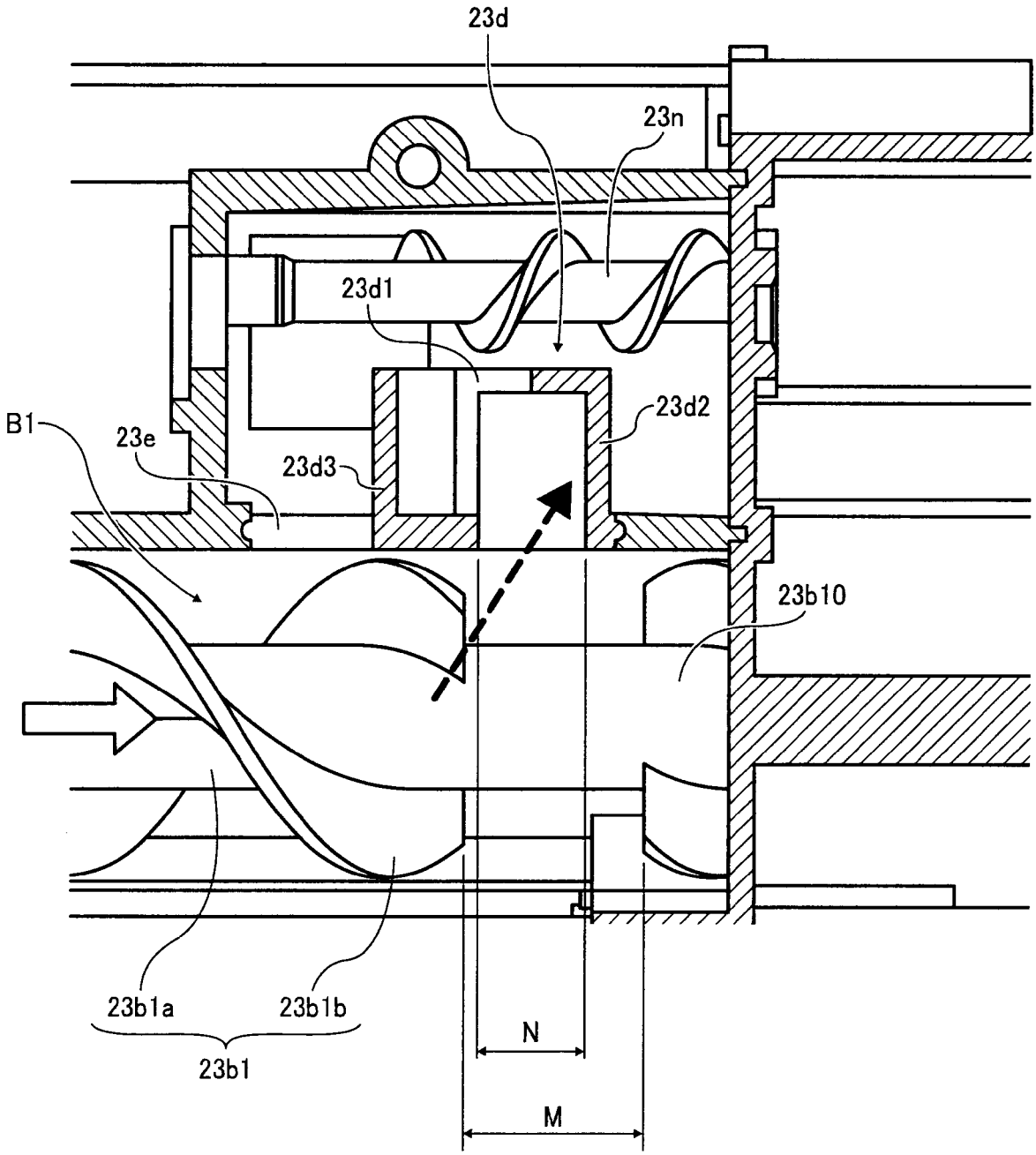
FIG. 8 is a top-view diagram indicating the configuration near the pocket part.
Figure 9:
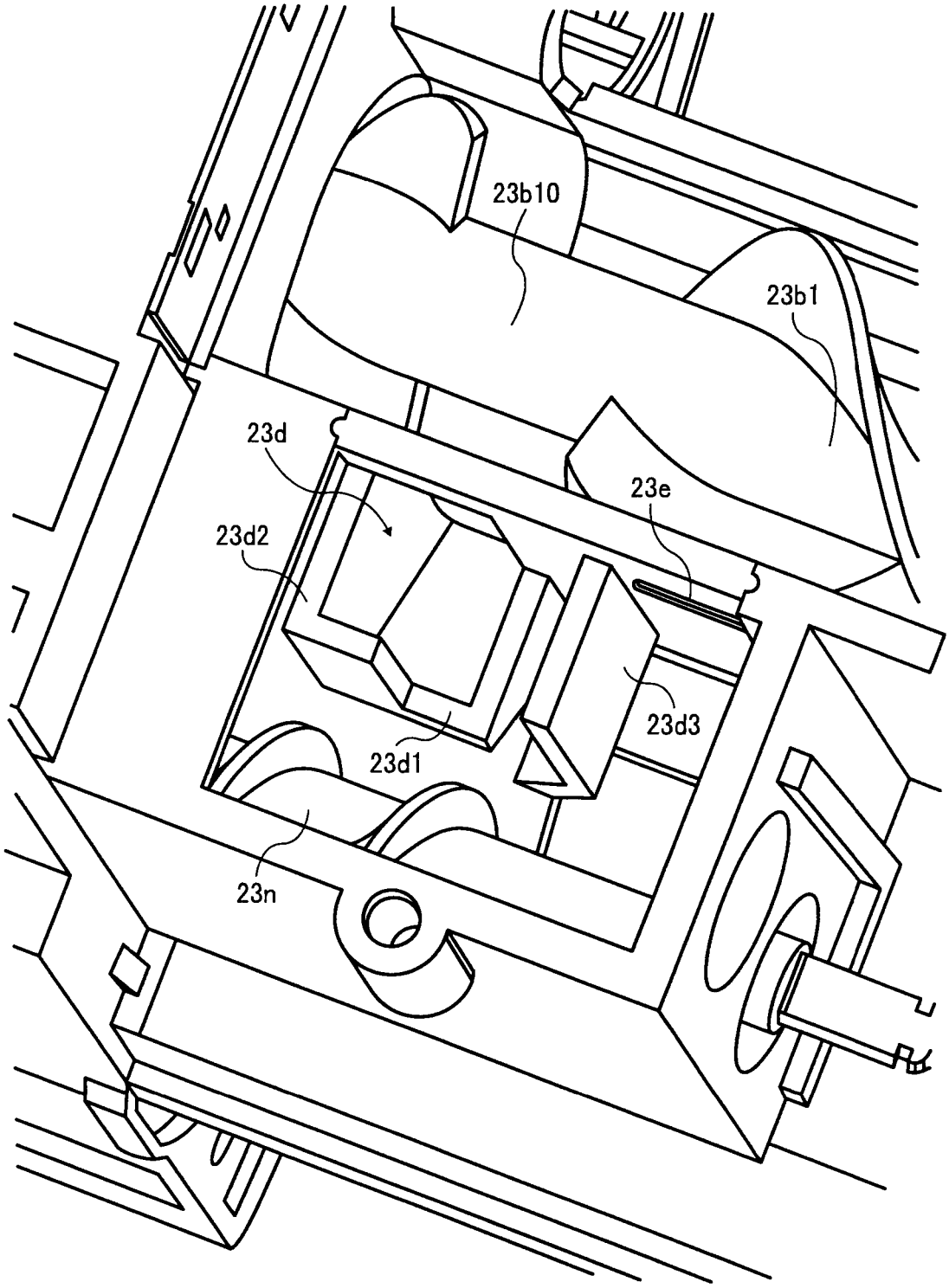
FIG. 9 is a perspective diagram indicating the configuration near the same pocket part.

Further, the diagrams in FIGS. 2 and 4 are abbreviated, but a discharge screw 23*n* for horizontally transporting the developer discharged from the discharge port 23*d*1 is installed in the discharge route 71 (refer to FIGS. 3, 8, and 9).

Moreover, a bypass route for returning some of the developer G to the upstream side of the circulation route without passing through the position where the previously described pocket part 23*d* (discharge port 23*d*1) is installed is formed in the circulation route of the developer in the developing device 23. Concretely, referring to FIGS. 4 and 6, an opening 23*e* is provided on the upstream side (a position roughly adjacent to the opening of the pocket part 23*d*) of the pocket part 23*d* (discharge port 23*d*1), which is at the first developer transport part B1. Then, this opening 23*e* is an inlet of the bypass route, and an outlet of the bypass route is arranged in the transport route (adjacent to the center longitudinally) formed by the third transport screw 23*b*3.

In this way, by providing a bypass route in the circulation route of the developer in the developing device 23, even if wave-shaped distortions are produced in the developer in the developing device, the problems of producing fluctuations in the amount of developer discharged from the discharge port 23*d*1 and of discharging more than the necessary amount of developer from the developing device 23 can be suppressed.

Figure 7:
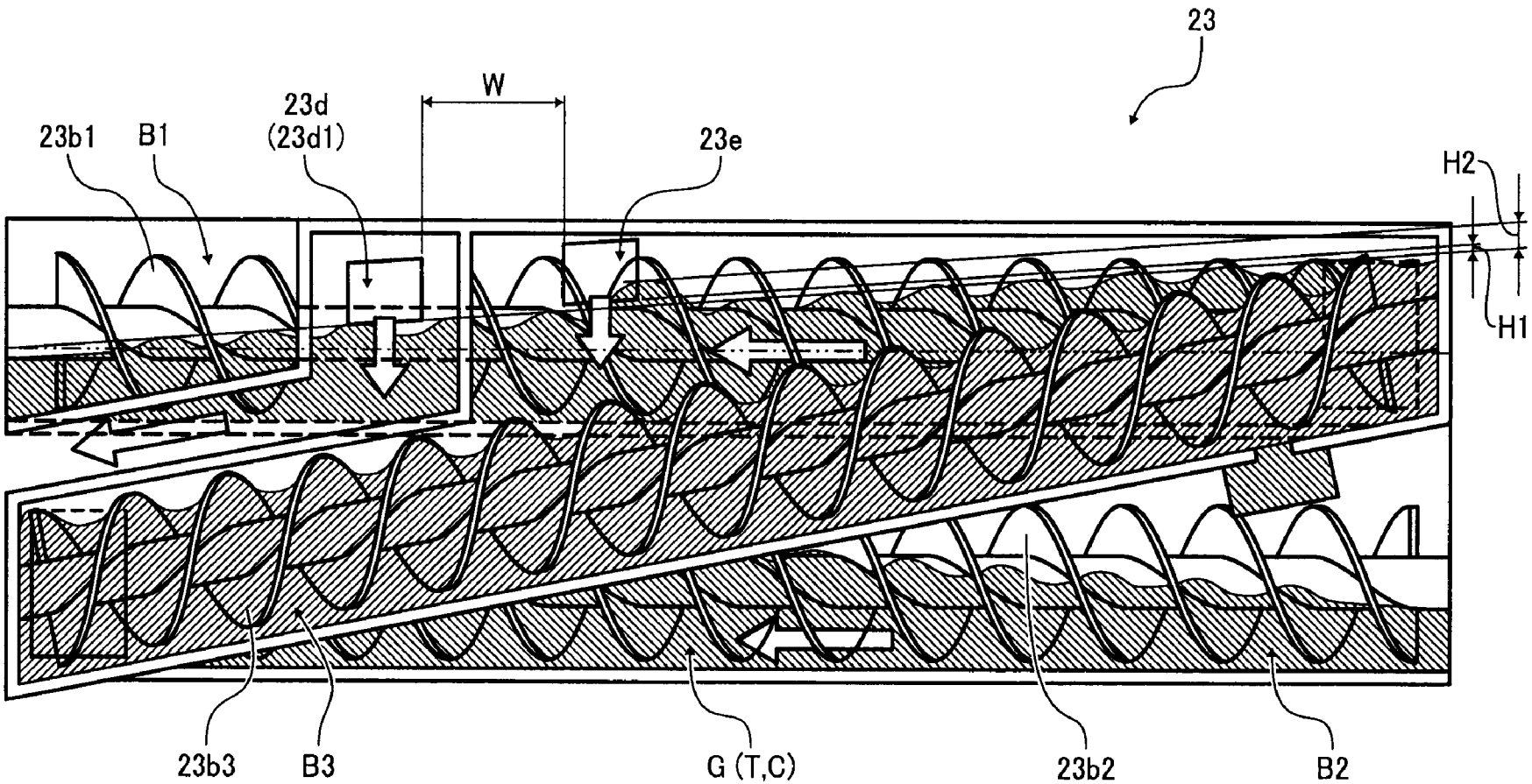
FIG. 7 is a diagram indicating the state when wave-shaped distortions are produced in the developer in the circulation route of FIG. 4.

FIG. 7 indicates the state when wave-shaped distortions in the developer are produced in the developer circulation route of the developing device 23. Wave-shaped distortions with a large high-low difference may be produced in the developer circulation route in this way. These wave-shaped distortions appear notably immediately after beginning operation of the developing device 23 (immediately after restarting). Then, when these wave-shaped distortions have been produced, unless there is a bypass route, all of the developer which is in a position higher than the bottom of the discharge port 23*d*1 (the developer at height H2 in FIG. 7) will be discharged from the discharge port 23*d*1. Because the developer that is discharged in this way was not originally scheduled for discharge, when this phenomenon happens repeatedly, the amount of developer in the developing device 23 becomes insufficient, leading to such problems as instability in the state of deterioration of the developer, a decrease in the amount of charge of the toner, and a reduction in the image concentration on the output image.

In contrast, in the present embodiment, part of the developer that is in the position higher than the lower part of the discharge port 23*d*1 is returned to the transport route of the third transport screw 23*b*3 through the opening 23*e* without being discharged from the discharge port 23*d*1 because the opening 23*e* that passes through to the bypass route is provided on the upstream side of the pocket part 23*d* (discharge port 23*d*1). The problem of discharging excessive developer from the discharge port 23*d*1 can thereby be avoided.

Here, the height of the lower part of the discharge port 23*e* of the bypass route is configured to be just a height H1 higher than the height of the lower part of the discharge port 23*d*1.

Of the developer that is in a position higher than the lower part of the discharge port 23*d*1, the portion of developer with a height of (H2-H1) will thereby be returned to the transport route of the third transport screw 23*b*3 through the opening 23*e* without being discharged from the discharge port 23*d*1. The problems of excessive developer being discharged from the discharge port 23*d*1 can be reliably prevented while maintaining the original function of the discharge means. Here, preferably the longitudinal distance W between the discharge port 23*d*1 and the opening 23*e* is as short as possible.

Referring to FIG. 3 (the indications are omitted from FIGS. 2 and 4), here in the present embodiment, carrier collection roller 23*k* is installed below the second developing roller 23*a*2 (downstream side in the direction of rotation) at a position facing the photosensitive drum 21. Further, the scraper 23*m* is installed in position contacting the carrier collection roller 23*k*.

The carrier collection roller 23*k* has a magnet that forms a specified magnetic field and that is fixed inside the cylinder made of stainless steel, etc., and is for the purpose of collecting the carrier that has moved (has flown) from within the developing device 23 and has adhered to the photosensitive drum 21. The carrier collection roller 23*k* is driven counterclockwise in FIG. 3. Nearly all of the carrier that is collected and supported by the carrier collection roller 23*k* moves onto the developing roller 23*a*2 at the position of facing the second developing roller 23*a*2, is released from the developing roller 23*a*2 at the position of the developer release pole of the developing roller 23*a*2, and is recovered into the second developer transport part B2. Meanwhile, the carrier that remains on and is supported by the carrier collection roller 23*k* without moving to the developing roller 23*a*2 is mechanically scraped off by the scraper 23*m*, and is recovered in the second developer transport part B2. In this way, the generation of abnormal images (firefly images and images with white blanks) can be avoided, and the problem of insufficient carrier in the developing device 23 can also be avoided because carrier adhering on top of the photosensitive drum 21 can be recovered into the developing device 23 by installing the carrier collection roller 23*k*.

The approximate settings in the present embodiment are: the outer diameters of the developing rollers 23*a*1 and 23*a*2 are 30 mm; the linear velocities of the peripheral surfaces of the developing rollers 23*a*1 and 23*a*2 are 748 mm/second; the outer diameter of the carrier collection roller 23*k* is 16 mm; the linear velocity of the peripheral surface of the carrier collection roller 23*k* is 10.6 mm/second; and the process linear velocity (linear velocity of the peripheral surface of the photosensitive drum 21, and the transport velocity of the transfer material P) is 440 mm/second.

Moreover, the carrier C used in the present embodiment has a particle size of about 55 μm, a saturation magnetization of 96 emu/g. Further, the toner T used in the present embodiment has a particle size of about 6.8 μm.

The characteristic configuration and operation of the developing device 23 of the present embodiment will be explained in detail below using FIGS. 8 to 11.

Figure 10:
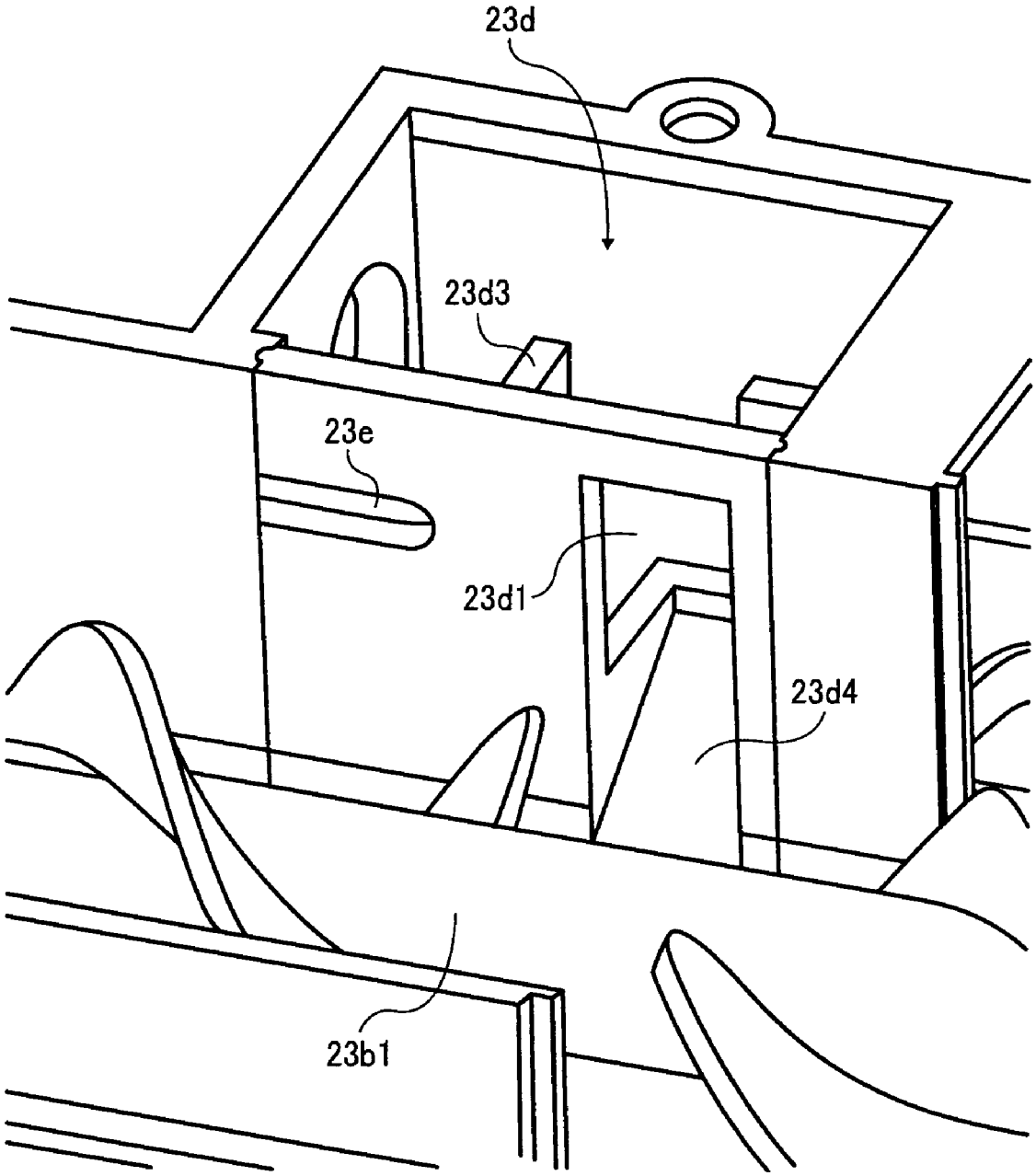
FIG. 10 is a perspective diagram indicating the configuration near the same pocket part from a different angle.
Figure 11:
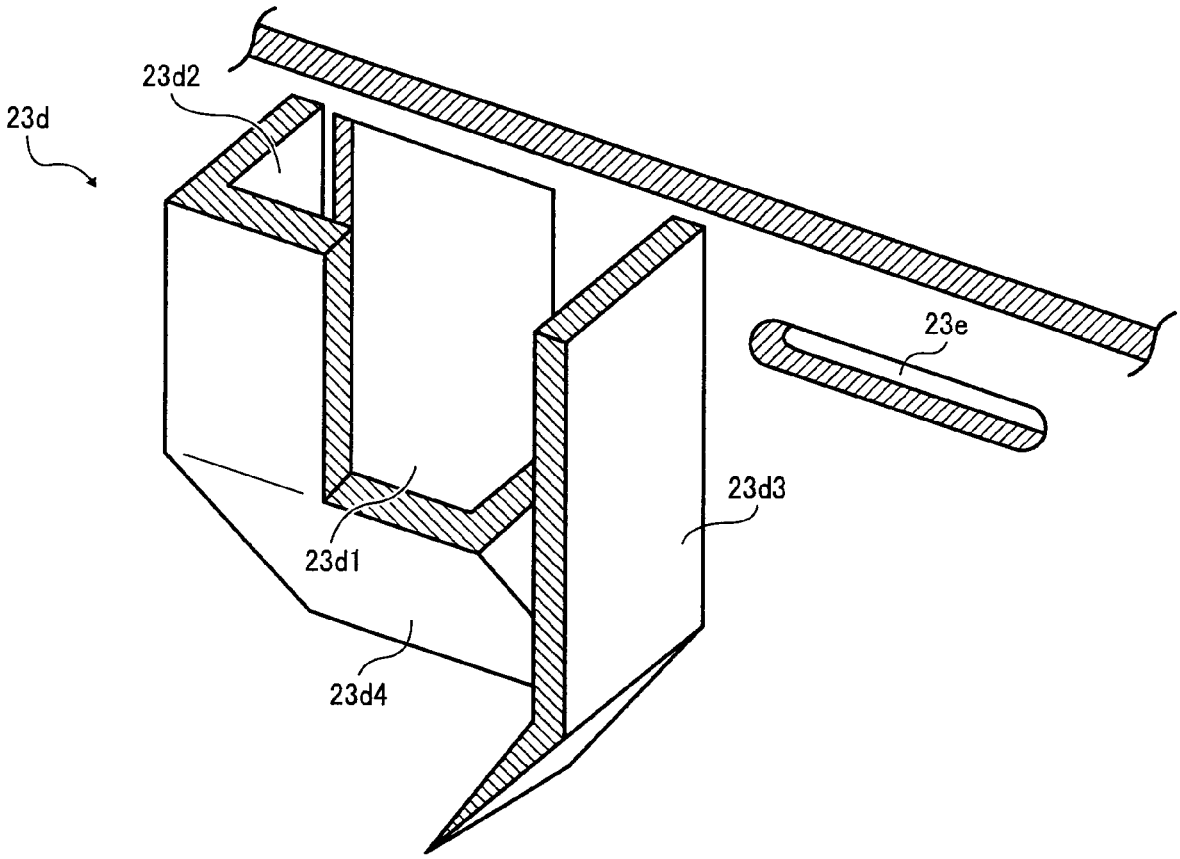
FIG. 11 is a perspective diagram indicating the configuration near the same pocket part from a different angle.

FIG. 8 is a top-view diagram indicating the vicinity near the pocket part 23*d*. FIG. 9 is a perspective diagram indicating the vicinity near the pocket part 23*d*. FIG. 10 is a perspective diagram indicating the vicinity near the pocket part 23*d* from a different angle. FIG. 11 is a perspective diagram indicating the vicinity near the pocket part 23*d* from a different angle.

As indicated in FIGS. 8 to 11, the pocket part 23*d* is installed on the wall of the carrier route formed by the first transport screw 23*b*1 (first developer transport part B1) facing the exterior in relation to the first developer transport part B1. Then, part of the developer transported in the first developer transport part B1 (developer flowing in the direction of the white arrow in FIG. 8) flows into and flows out of the pocket part 23*d*. In more detail, developer flows from the opening of the pocket part 23*d* (opening provided on the wall of the first developer transport part B1) into the pocket part 23*d*, and the developer in the pocket part 23*d* flows out along the diagonal bottom 23*d*4 of the pocket part 23*d* toward the first developer transport part B1, and as a fixed amount or more flows, developer is accumulated in the pocket part 23*d*.

Referring to FIGS. 10 and 11, here the flowing of developer in and out of the pocket part 23*d* occurs smoothly because the bottom 23*d*4 of the pocket part 23*d* is formed diagonally at a specified angle (an angle sufficient for developer to slide down the bottom 23*d*4) downward toward the first developer transport part B1.

Referring to FIG. 8, the discharge port 23*d*1 is arranged on the side corresponding to the upstream side of the first developer transport part B1 (in the range upstream from the center) in the pocket part 23*d*. Then, if the developer surface that has flowed into the pocket part 23*d* exceeds a specified height (the lower height of the discharge port 23*d*1, that developer is discharged from the discharge port 23*d*1 to the outside of the developing device 23. In more detail, after falling onto the discharge route by its own weight, the developer discharged from the discharge port 23*d*1 is transported toward the developer storage container by the discharge screw 23*n*.

Figure 12:
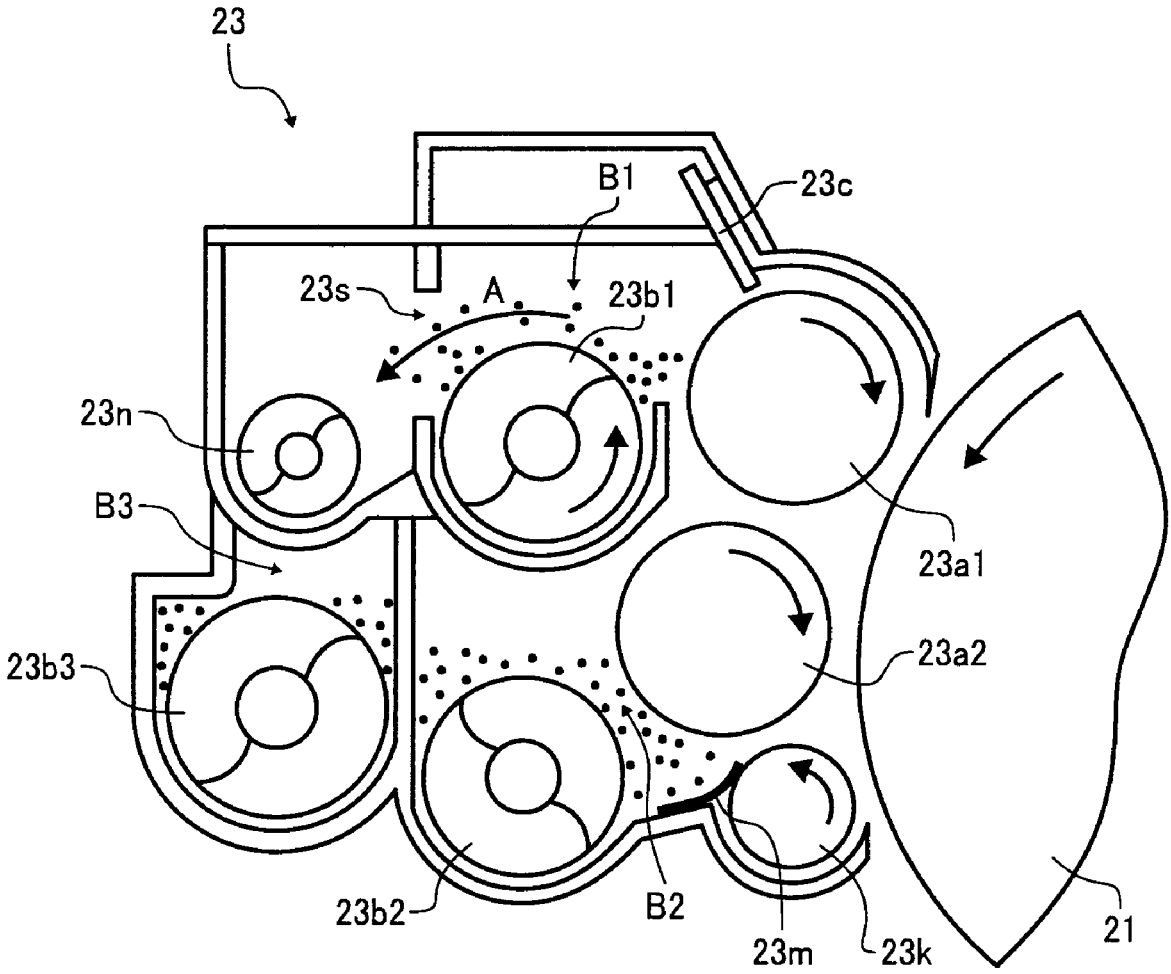
FIG. 12 is a diagram indicating the state when the developer splashed by the first transport member penetrates into the discharge port.

The wall part 23*d*2 covers the pocket part 23*d* on the side corresponding to the downstream side of the first developer transport part B1 (in the range downstream from the center). The developer splashed by the screw part 23*b*1*b* of the first transport screw 23*b*1 penetrates into the pocket part 23*d* and collides with the wall part 23*d*2 (the movement of the developer is indicated by the dotted arrow in FIG. 8). The developer that has collided with the wall part 23*d*2 piles up into the fluid state developer accumulated in the pocked part 23*d*. Specifically, as indicated in FIG. 12, if the discharge port 23*s* is directly formed on the wall of the transport route as in the past, developer that has been splashed by the screw part 23*b*1*b* of the first transport screw 23*b*1 is discharged from the discharge port 23*s* to the outside. In contrast, in the present embodiment, developer that has been splashed by the first transport screw 23*b*1 and has penetrated into the pocket part 23*d* is received and stopped by the wall part 23*d*2, and problem of excessive developer being discharged from the developing device 23 can be avoided because the discharge port 23*d*1 has been provided in a location where the developer that has been splashed does not directly enter.

In addition, as indicated in FIGS. 8 to 10, the screw part 23*b*1*b* of the first transport screw 23*b*1 is formed into a spiral shape on the spindle 23*b*1*a*. Then, in the present embodiment, a cutaway region 23*b*10 is provided in which the screw part 23*b*1*b* is not formed in part of the longitudinal direction of the first transport screw 23*b*1 (the range M in the diagram, the range where only the spindle 23*b*1*a* has been formed). The cutaway region 23*b*10 in which this screw part 23*b*1*b* is not formed is downstream of the first developer transport part B1 (transport route formed by the first transport screw 23*b*1), and is provided in the non-image forming region (region that does not participate in image formation).

Moreover, the pocket part 23*d* faces the cutaway region 23*b*10 of the first transport screw 23*b*1, and is formed such that the longitudinal length N of the opening is smaller than the longitudinal (direction of rotational axis) length M of the cutaway region 23*b*10 (M>N). Further, the pocket part 23*d* is downstream of the first developer transport part B1, and is provided in a non-imaging region.

The amount of developer splashed in this vicinity can be reduced by providing in this way the cutaway region 23*b*10 on the first transport screw 23*b*1. Further, the amount of splashed developer that penetrates the pocket part 23*d* upstream of the cutaway region 23*b*10 can be efficiently reduced by making the longitudinal length N of the opening of the pocket part 23*d* smaller than the longitudinal length M of the cutaway region 23*b*10, and by making the opening face within the range of the cutaway region 23*b*10. Because the amount of developer that penetrates into the pocket part 23*d* by splashing can be reduced in this way, the effect of the pocket part 23*d* (wall part 23*d*2) described above furthers the reliability, and prevents the problem of the developer within the developing device 23 being excessively discharged, leading to an insufficient amount of developer.

Experiments conducted by the three inventors of the present application confirmed that, according to the configuration described above, the amount of developer that is splashed by the first transport screw 23*b*1 and is then discharged from the discharge port 23*d*1 is reduced compared to when the discharge port 23*s* is directly formed on the wall of the transport route as in FIG. 12.

Further, the cutaway region 23*b*10 is formed in the first transport screw 23*b*1 in the present embodiment, but it was confirmed that even if the cutaway region 23*b*10 is not formed in the first transport screw 23*b*1, the amount of developer that is splashed by the first transport screw 23*b*1 and is then discharged from the discharge port 23*d*1 is dramatically reduced by providing a pocket part 23*d* equivalent to that in the present embodiment.

On the other hand, it has been confirmed that, by providing the cutaway region 23*b*10 on the first transport screw 23*b*1, the diagonal of the developer (the phenomenon in which the downstream developer surface becomes lower than the upstream surface as explained earlier using FIG. 4) in the first developer transport part B1 becomes smaller compared to when the cutaway region 23*b*10 is not provided, and it becomes more difficult for augur stripes (image irregularities caused by the pitch of the screw part 23*b*1*b* when the developer level is low downstream) to occur.

Here in the present embodiment, the pocket part 23*d* and the cutaway region 23*b*10 are on the downstream side of the first developer transport part B1 and are provided in a non-imaging region. An affect on the output image by cutting away the screw part 23*b*1*b* of the first transport screw 23*b*1 or an affect on the output image by providing the pocket part 23*d* can thereby be eliminated.

Further, as indicated in FIGS. 8 and 9, the pocket part 23*d* is preferably formed so as not to face the upstream side in relation to the cutaway region 23*b*10 (upstream side of the first developer transport part B1). Specifically, it is preferable that the upstream end of the pocket part 23*d* be provided in a position separated from the upstream end of the cutaway region 23*b*10. Again, in other words, it is preferable that the pocket part 23*d* is arranged to face the range from the center of the cutaway region 23*b*10 to the downstream side.

By configuring in this way, the amount of developer that is splashed on the upstream side of the cutaway region 23*b*10 by the rotation of the first transport screw 23*b*1 and that penetrates into the pocket 23*d* can be reliably reduced even more.

Figure 6:
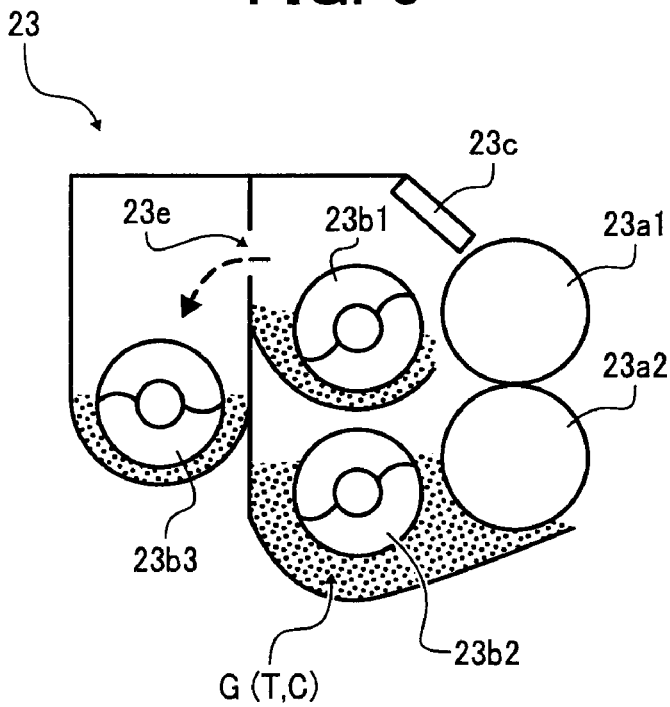
FIG. 6 is a schematic cross-sectional diagram indicating the Y2-Y2 cross-section of the circulation route of FIG. 4.

In the present embodiment, as previously explained using FIGS. 4 and 6, the opening 23*e* of the bypass route, which is for returning some of the developer to the upstream side of the circulation route without passing through the position where the pocket part 23*d* is arranged, is provided on upstream of the pocket part 23*d*. Then, a partition wall 23*d*3 that separates the bypass route and the pocket 23*d* outside of the first developer transport part B1 is installed between the bypass route and the pocket part 23*d*. In this way, even if the bypass route and the pocket part 23*d* are adjacent, the problem of intermixing the developer flowing along the bypass route and the developer discharged from the pocket part 23*d* (discharge port 23*d*1) can be avoided. Further in the present embodiment, as indicated in FIGS. 9 and 11, the developer discharged from the discharge port 23*d*1 can be reliably discharged toward the discharge route because the lower end of the partition wall 23*d*3 bends in the shape of the Japanese character "ク"to the pocket part 23*d* side.

As explained above, in the present embodiment the pocket part 23*d* that protrudes to the outer part of the first developer transport part B1 (transport route) is provided, the developer splashed by the first transport screw 23*b*1 (transport part) is made to collide with the wall part 23*d*2 of the pocket part 23*d*, and part of the developer that has flowed into the pocket 23*d* is discharged from the discharge port 23*d*1; and therefore a developing device 23 of a premix developing system can be provided by which the developer splashed by the first transport screw 23*b*1 is not discharged from the developing device 23, fluctuations in the amount of developer discharged to the outside are not produced, and the quality of the output image is stable.

Further, in the present embodiment, the present invention was applied to a developing device 23 with three developer transport parts B1 to B3 installed, but the present invention could be applied even to developing device 23 in which 2 or less or 4 or more developer transport parts are installed. In these cases as well, similar effects as those of the present embodiment can be obtained.

Moreover, in the present embodiment the third transport screw 23*b*3 was arranged at a diagonal to horizontal, but the third transport screw 23*b*3 could also be arranged horizontally.

Further, in the present embodiment the pocket part 23*d* was provided on the wall part of the first developer transport part B1, but the pocket part 23*d* could also be provided on the walls of the other developer transport parts B2 and B3.

Moreover, in the present embodiment developer G (toner T and carrier C) is provided to the developing device 23 from the developer cartridge 28, which is the supply means, but the carrier C alone could be supplied to the developing device 23 from the supply means. In this case, a toner cartridge that houses only toner is installed separately from the developer cartridge (carrier cartridge), and the toner housed in the toner cartridge suitably replenishes the developing device 23 based on the detection results of the magnetic sensor 26. Even in this case, a similar effect to that of the present embodiment can be obtained.

Moreover, in the present embodiment the present invention is applied to an image forming apparatus in which part of the image making unit is configured by a process cartridge 20. However, the use of the present invention is not limited to this, and naturally the present invention can be applied to an image forming apparatus that does not make the image making unit into a process cartridge. Concretely, the present invention can be applied even when the developing device 23 is configured by a unit that attaches and detaches to the image forming apparatus main body as a single body.

Further, in the present embodiment, the present invention was applied to a developing device 23 with two developing rollers 23*a*1 and 23*a*2 installed, but naturally the present invention could be applied to a developing device with one, or three or more developing rollers. Even in this case, a similar effect to that of the present embodiment can be obtained.

As explained above, a developing device, process cartridge and image forming apparatus of a premix developing system, which do not discharge developer splashed by the transport member from the apparatus and does not produce fluctuations of the amount of developer discharged to the outside and for which the quality of the output image is stable, can be offered because the present invention provides a pocket part that protrudes to the outside of the transport route, the developer splashed by the transport member collides with the wall of the pocket part, and part of the developer that has flowed into the pocket part is discharged from the discharge port.

Various modifications will become possible for those skilled in the art after receiving the teachings of the present disclosure without departing from the scope thereof.

What is claimed is:

1. A developing device which houses developer having carrier and toner, and which develops a latent image formed on an image support unit, the developing device comprising:

a plurality of transport members for longitudinally transporting the developer housed in the device to form a circulation route;

supply means for supplying new carrier into the device; and a pocket part, which is installed in a depressed manner on a wall of a transport route formed by one of the plurality of transport members, facing outside in relation to the transport route, extending beyond the wall of the transport route, and into and out of which part of the developer transported in the transport route flows, wherein the pocket part includes a wall part that covers a side corresponding to a downstream side of the transport route, and a discharge port to discharge developer outside of the device when a surface of the developer flowing into the pocket part exceeds a specified height within the pocket part.

2. The developing device as claimed in claim 1, wherein the pocket part is formed such that the bottom thereof slants downward toward the side of the transport route.

3. The developing device as claimed in claim 1, wherein the discharge port is arranged on the side corresponding to the upstream side of the transport route.

4. The developing device as claimed in claim 1, wherein one of the transport members has a screw part formed on a spindle part, and includes, in a part thereof in the longitudinal direction, a cutaway region in which the screw part is not formed, and the pocket part is arranged at a position facing the cutaway region.

5. The developing device as claimed in claim 4, wherein the pocket part is formed such that the longitudinal length of the opening thereof is smaller than the longitudinal length of the cutaway region.

6. The developing device as claimed in claim 4, wherein the pocket part is formed not to face the upstream side of the transport route in relation to the cutaway region.

7. The developing device as claimed in claim 1, wherein the pocket part is formed on the downstream side of the transport route.

8. The developing device as claimed in claim 1, further comprising:

on the upstream side of the transport route in relation to the pocket part, an opening of a bypass route that returns part of the developer to the upstream side of the circulation route without passing through the position where the pocket part is arranged; and a partition wall that separates the bypass route and the pocket part outside of the transport route.

9. The developing device as claimed in claim 1, further comprising:

a developer support unit that faces the image support unit and supports the developer, wherein the plurality of transport members each include a first transport member that faces the developer support unit and supplies the developer to the developer support unit; a second transport member that is arranged below the first transport member and in a position facing the developer support unit, and that transports the developer released from the developer support unit; a third transport member that transports the developer transported by the second transport member to the upstream side of the transport route formed by the first transport member; and a wall part for separating the transport route formed by the first transport member, the transport route formed by the second transport member, and the transport route formed by the third transport member, and the one of the transport members is the first transport member.

10. The developing device as claimed in claim 1, wherein the supply means supplies new toner into the device together with the carrier.

11. A process cartridge that is detachably installed to an apparatus main body of an image forming apparatus, wherein a developing device and an image support unit are formed into a single unit, and wherein the developing device houses developer having carrier and toner, and develops a latent image formed on an image support unit, the developing device comprising:

a plurality of transport members for longitudinally transporting the developer housed in the device to form a circulation route;

supply means for supplying new carrier into the device; and a pocket part, which is installed in a depressed manner on a wall of a transport route formed by one of the plurality of transport members, facing outside in relation to the transport route, extending beyond the wall of the transport route, and into and out of which part of the developer transported in the transport route flows, wherein the pocket part includes a wall part that covers a side corresponding to a downstream side of the transport route, and a discharge port to discharge developer outside of the device when a surface of the developer flowing into the pocket part exceeds a specified height within the pocket part.

12. An image forming apparatus, comprising a developing device and an image support unit, wherein the developing device houses developer having carrier and toner, and develops a latent image formed on an image support unit, the developing device comprising:

a plurality of transport members for longitudinally transporting the developer housed in the device to form a circulation route;

supply means for supplying new carrier into the device; and a pocket part, which is installed in a depressed manner on a wall of a transport route formed by one of the plurality of transport members, facing outside in relation to the transport route, extending beyond the wall of the transport route, and into and out of which part of the developer transported in the transport route flows, wherein the pocket part includes a wall part that covers a side corresponding to a downstream side of the transport route, and a discharge port to discharge developer outside of the device when a surface of the developer flowing into the pocket part exceeds a specified height within the pocket part.

13. The image forming apparatus as claimed in claim 12, wherein the pocket part is formed such that the bottom thereof slants downward toward the side of the transport route.

14. The image forming apparatus as claimed in claim 12, wherein the discharge port is arranged on the side corresponding to the upstream side of the transport route.

15. The image forming apparatus as claimed in claim 12, wherein one of the transport members has a screw part formed on a spindle part, and includes, in a part thereof in the longitudinal direction, a cutaway region in which the screw part is not formed, and the pocket part is arranged at a position facing the cutaway region.

16. The image forming apparatus as claimed in claim 15, wherein the pocket part is formed such that the longitudinal length of the opening thereof is smaller than the longitudinal length of the cutaway region.

17. The image forming apparatus as claimed in claim 15, wherein the pocket part is formed not to face the upstream side of the transport route in relation to the cutaway region.

18. The image forming apparatus as claimed in claim 12, wherein the pocket part is formed on the downstream side of the transport route.

19. The image forming apparatus as claimed in claim 12, further comprising;

on the upstream side of the transport route in relation to the pocket part, an opening of a bypass route that returns part of the developer to the upstream side of the circulation route without passing through the position where the pocket part is arranged; and a partition wall that separates the bypass route and the pocket part outside of the transport route.

20. The image forming apparatus as claimed in claim 12, further comprising:

a developer support unit that faces the image support unit and supports the developer, wherein the plurality of transport members each include a first transport member that faces the developer support unit and supplies the developer to the developer support unit; a second transport member that is arranged below the first transport member and in a position facing the developer support unit, and that transports the developer released from the developer support unit; a third transport member that transports the developer transported by the second transport member to the upstream side of the transport route formed by the first transport member; and a wall part for separating the transport route formed by the first transport member, the transport route formed by the second transport member, and the transport route formed by the third transport member, and the one of the transport members is the first transport member.

21. The image forming apparatus as claimed in claim 12, wherein the supply means supplies new toner into the device together with the carrier.

* * * * *